US005215411A

United States Patent [19]

Seegmiller

[11] Patent Number: 5,215,411

[45] Date of Patent: * Jun. 1, 1993

[54] YIELDABLE MINE POST SYSTEM

[76] Inventor: Ben L. Seegmiller, 143 S. 400 East, Salt Lake City, Utah 84111

[ * ] Notice: The portion of the term of this patent subsequent to May 14, 2008 has been disclaimed.

[21] Appl. No.: 673,364

[22] Filed: Mar. 22, 1991

[51] Int. Cl.[5] ..... E21D 15/22

[52] U.S. Cl. ..... 405/290; 248/354.1; 403/374; 405/288

[58] Field of Search ..... 405/272, 282, 288, 290; 188/371; 248/354.1; 403/374, 409.1

[56] References Cited

U.S. PATENT DOCUMENTS

| | | | |
|---|---|---|---|
| 2,036,490 | 4/1936 | Neilson et al. | 405/288 |
| 2,532,168 | 11/1950 | Jakoubek | 405/290 X |
| 4,382,721 | 5/1983 | King | 405/288 |
| 5,015,125 | 5/1991 | Seegmiller | 405/288 |

*Primary Examiner*—David H. Corbin
*Attorney, Agent, or Firm*—M. Ralph Shaffer

[57] ABSTRACT

A yieldable mine post system having a yieldable mine post construction, made of metal and in telescoping form. The post of the invention comprises a pair of mutually telescoping metal post lengths. The innermost tubular post length has a medial bubble portion of enlarged girth which is oversize relative to the nominal inside diameter of the outermost tubular post length. The result, consequently, is not only to increase the frictional resistance between the post lengths but also to create a bubble zone characterized by elastic/plastic mutually inter-cooperating radial deformation and elastic stress-loading of the telescoping post construction, for further progressively increasing resistance of the composite post structure to compression end loading of such post. The yieldable mine post construction can be made adjustable and also radially preloaded and preset for immediate, desired load resistance. A mine vehicle can also be provided, not only for transporting the yieldable mine posts to a mine site, but also be operative to lift and erect in vertical or other positions such mine posts. The vehicle may have hydraulic or other means for axially rotating and thereby tightening the posts in position.

28 Claims, 4 Drawing Sheets

YIELDABLE MINE POST SYSTEM

FIELD OF INVENTION

The present invention relates to mine roof supports and, more particularly, provides a new and useful telescoping yieldable mine post for facilitating both mine roof support and roof strata control. A preferred form of the invention is to provide a pre-stressed, adjustable, yieldable mine post having an immediate desired resistance-to-end-loading characteristic. A further part of the system includes a mine vehicle for transporting yieldable mine posts and also for erecting the same in vertical or other position and twisting or rotating the same about their individual axes for tightening the posts within the mine.

BACKGROUND AND BRIEF DESCRIPTION OF PRIOR ART

The present invention relates to roof control in underground mines such as coal mines, trona mines, and the like.

A detailed background and description of certain prior art is found in the co-pending, allowed patent application entitled Yieldable Mine Post, Ser. No. 07/503,654 filed Apr. 5, 1990; the entire specification and descriptions therein are fully incorporated herein by way of reference. For a rather extensive treatment as to the background of the art, the reader is respectfully referred to this incorporated patent.

Additional prior art made of record incited in the prosecution of the earlier case by the following patents:

| U.S. PAT. NO. | |
|---|---|
| 1006163 | 1538785 |
| 3877319 | 4995567 |
| 4006647 | 4100749 |
| 4344719 | 4302721 |
| FOREIGN PATENTS | |
| 2904741 (Germany) | |
| 2045312 (Great Britain) | |

Both in this and in the inventor's prior patent, a telescoping tubular construction is provided. In the latter the innermost post length, mainly in tubular developed form, or simply a slotted tube, is provided, but with the inner tubular post being compressed and tack welded at its slot so that the innermost post length may be conveniently slid into and carried by the outermost post length. For mutual, wall-friction developing purposes, the inner tubular post length is inserted into the outer tubular post length, then the tack welds broken so that the innermost tubular post length expands radially outwardly so as to produce or commence a wall-friction characteristic desired. Subsequent insertion of a wedge in the slotted portion of the innermost tubular post length serves to increase the girth of the innermost tubular post length so as to result in the friction bubble needed, as fully explained in this above-referenced patent. The wall thicknesses of the innermost and outermost tubular post lengths of such prior patent are shown substantially enlarged for convenience of illustration.

The inventor has taken this concept a considerable step further in the present invention in providing innermost and outermost tubular post lengths which, in their nominal dimension, and when telescoped together, provide a space between the outer wall surface of the innermost post length and the inner wall surface of the outermost post length. The innermost post length is configured to produce the pressure bubble needed to offer resistance to end loading of the post construction.

BRIEF DESCRIPTION OF INVENTION

In the present invention, and as above alluded to, there is provided a yieldable mine post construction comprising a pair of tubular post lengths, namely, an innermost tubular post length which telescopes into an outermost tubular post length. These post lengths in one form of the invention are sized as to diameter so that, in their nominal dimension, the innermost tubular post length will easily slip into the outermost tubular post length. Between the walls of the pair will exist a nominal spacing of at least a few thousands of an inch, whereby to provide for an easy telescoping collapse of the post lengths for transit, and easy movement as may be desired during installation. The innermost tubular post length has a longitudinal wall slot which will accommodate insertion of a wedge therein such as to expand the slot at the point of wedge insertion and, likewise, the diameter of the innermost tubular post length. The materials and dimensions for the wedge and inner and outer post lengths are so selected that the wedge insertion augments sliding wall-surface friction between the two post lengths by supplying an elastic-plastic, mutually radial deformation, proximate the zone of wedge insertion, relative to the inter-cooperation between the inner and outer tubular post lengths. The result is that there is a radially elastic loading as to the walls of both inner and outer tubular post lengths proximate the area of the wedge whereby to expand incrementally, and elastically, and also within the mutual plastic ranges of the post lengths, the inner and outer tubular post lengths proximate the wedge region. This occurs at least at the time the wedge enters the overlapping end of the outermost tubular post length as the composite yieldable mine post construction is end loaded. A characteristic operation curve is produced, as one plots loading-support relative to load-displacement, which is superior to that previously produced. In the present invention, in one form thereof, contrasted the inventor's prior patent, the necessity for prior radial compression of the innermost tube, and well as the provision of tack welds proximately longitudinal slot of the innermost tubular post length, are eliminated. In another form of the invention, several embodiments are illustrated whereby the desired pressure zone and pressure bubble are employed, in various configurements, whereby to produce the transverse radial loading desired at a designated portion relative to the intercooperating tubular post lengths.

A preferred form of the invention includes a yieldable mine post of the type described but which includes an end, generally at the lower end, which is extensible in length. This is achieved principally by a threaded rod which threads into the innermost tubular post length. Workmen either manually place the yieldable mine post in vertical or other desired condition and then rotate these about their vertical axes, manually, or, and preferably, a mine vehicle is provided not only for transporting the mine posts but also for vertically or otherwise erecting and also rotating the same to respective tightened conditions.

OBJECTS

Accordingly, a principal object of the present invention is to provide a new and improved yieldable mine post construction having an intermediate, interference-fit friction bubble, of whatever particular design selected.

A further object is to provide a telescoping metal mine post provided with the capability of increased frictional and other resistance forces responsive to incremental closures of the telescoping post lengths of such post.

An additional object is to provide a yieldable mine post construction wherein the provided telescoping innermost and outermost tubular post lengths have nominal dimensions whereby the innermost post length can easily be slid into the outermost post length; however, when a wedge is used, as provided herein, to increase, at the point of wedge insertion, the longitudinal slot of the innermost post length, a friction bubble or friction zone is created, tending to increase resistance of the composite post construction to end loading, and this in the desired pattern.

A further object of the invention is to provide a telescoping yieldable mine post construction designed to accommodate and facilitate roof strata control by permitting control through selective yielding at post installation areas as may be desired.

A further object is to provide a yieldable mine post construction wherein the same is pre-stressed, radially, whereby to produce immediately, or nearly immediately, the load resistance characteristic desired for such post; such post can also made adjustable, recoverable, and not only preloaded, but susceptible to either automated or manual vertical placement within a mine.

A further object is to provide a yieldable mine post system wherein the same permissibly includes a mine vehicle constructed to transport mine posts and also to vertically or otherwise install the same in a desired manner.

BRIEF DESCRIPTION OF THE DRAWINGS

The present invention, together with further objects and advantages thereof, may best be understood by reference to the following description, taken in conjunction with the accompanying drawings in which:

FIG. 17 is a fragmentary detail of another form of inner post member incorporating a sleeve to constitute the friction bubble spoken of.

DETAILED DESCRIPTION OF PREFERRED EMBODIMENTS

Figure 1:
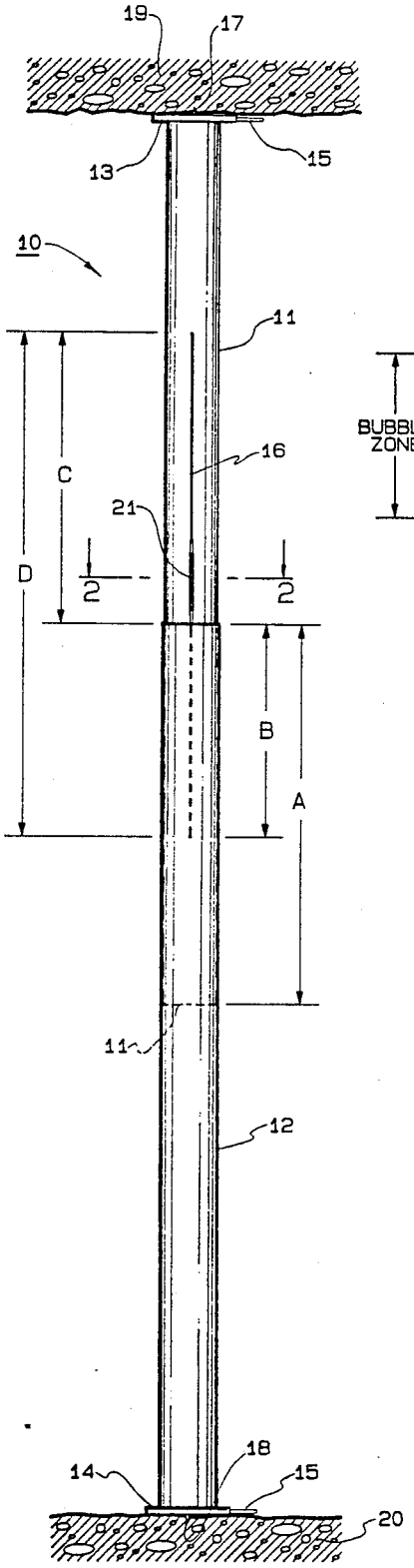
FIG. 1 is a side elevation, partially in section, of a yieldable mine post construction that is installed between the floor and roof of an underground mine opening.
Figure 4:
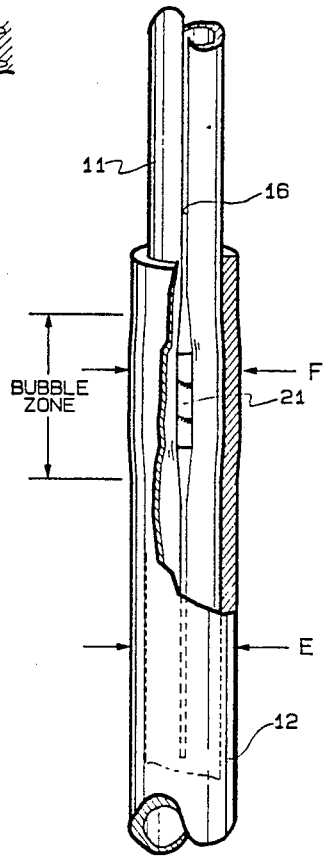
FIG. 4 is an enlarged fragmentary view of a medial portion of the post in FIG. 1, and is partially broken away so as to illustrate wedge insertion.

In FIG. 1, a mine support post 10 includes a pair of telescoping, tubular post lengths, namely, innermost tubular post length 11 and outermost tubular post length 12. Each of these post lengths generally will be provided with a bearing plate 13 and 14, welded to the opposite ends as indicated. These bearing plates may be provided with loop shaped handles 15 as more fully described in the inventor's prior patent above referenced. The innermost tubular post length 11 includes a longitudinal wall slot 16 which, while the same might conceivably proceed from end to end relative to such innermost tubular post length, will generally be a milled slot positioned substantially intermediate such ends, this as illustrated in FIGS. 1 and 4.

If decided, pointed protuberances or protrusions 17 and 18 will be provided the opposite bearing plates for aiding the maintenance of positioning of the opposite ends of the composite support post relative to roof and floor strata 19 and 20.

Figure 2A:
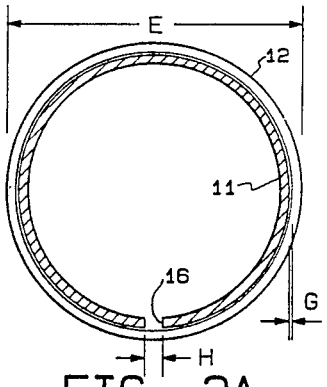
FIG. 2A is a transverse horizontal section taken along line 2—2 in FIG. 1, is enlarged for purposes of clarity, and shows the tubular post lengths in their nominal condition prior to wedge insertion.

Assume, merely by way of example, that each of the post lengths is five feet three inches long, having a central overlap, as indicated at dimension A of two feet three inches. Assume further that the following dimensions are present in the example. B equals one foot three inches, C equals 36 inches, D equals 21 inches, E equals 4 inches, F equals 4.020 inches, G equals 0.010 inches, slot width H is 0.25 inches, and the outer nominal diameter of tubular post length 11 in FIG. 2A is 3.75 inches. Thus, where the nominal outside diameter E of the outermost tubular post length is 4 inches and the nominal outside diameter of the innermost tubular post length is 3.75 inches, conventional tubular stock may be chosen such that, relative to their wall thicknesses, an air gap between the tubular post lengths will be of the order of 0.010 inches on either side, or a combined air-gap total of 0.020 inches.

Figure 2B:
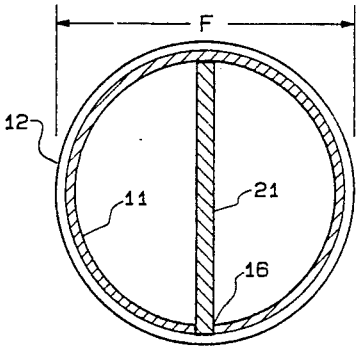
FIG. 2B is similar to FIG. 2A, and illustrates the condition of the telescoping tubular post lengths wherein the wedge has been inserted so as to expand the groove of the innermost tubular post length, the girths of the two tube lengths, and likewise produce the friction bubble or friction zone that will hereafter be described.
Figure 3:
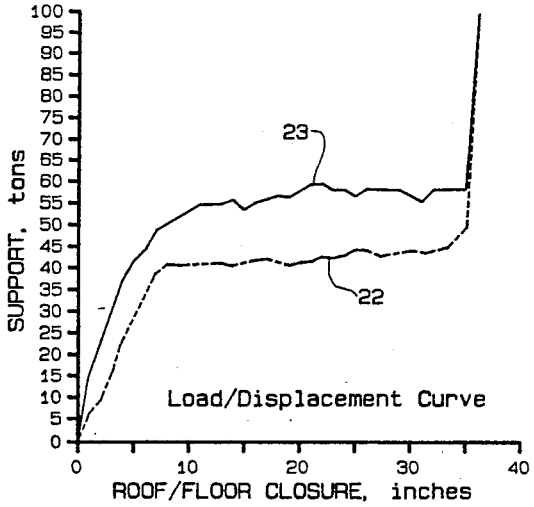
FIG. 3 is a graph of loading of support in tons when plotted against roof-floor closure, the lower curve indicating results achieved and representable tests by constructions made in accordance with the inventor's prior patent and the upper curve indicating the elevated displacement curve achieved in tests made of structures formed in accordance with the teachings in this case.

A representative dimension-set for the wedge 21 will be ½ inches in thickness, 3" in vertical length, and a horizontal width sufficient to span the interior opening of the innermost tubular post length and fill slot 16 flush with its outside wall as indicated in FIG. 2B. The dimensions given are representative only for a particular example. The dimensions may, of course, be altered in connection with mine parameters, the load displacement curve desired, as well as for other reasons.

The mine support post construction, as to the initial form shown, operates as follows. Assume that the post is installed in the manner as seen in FIG. 1, with appropriate tooling provided on site for temporarily increasing slot width to effect wedge insertion as seen in FIG. 1 being provided.

Before wedge insertion, the air gap of 0.020", for example, two times dimension G, will be seen between the two tubular lengths that easily telescope as a consequence. After wedge insertion, the girth of the inner tubular post length will be expanded so as to at least eliminate the air gap between the two tubular lengths. As the roof commences to settle, then this will cause the inner tubular post length to penetrate further into the lower, outermost post length. It will be noted that not only does the air gap close between the two tubular lengths, but also the dimension of the wedge and the transverse dimensions of the post lengths themselves, and slot, originally only one-quarter of an inch wide, e.g. serve such that there will be an expansion of the outer girth of the inner tubular post length relative to the nominal inner transverse wall boundary or inner wall surface of the outermost post length. This will result in an outer radial compression of the wall of the outermost tubular post length and correspondingly, an inward compression of the wall of the innermost tubular post length, both compressions and radial transverse loading being within the plastic/elastic range limits of the tube materials. Again, dimensions are chosen such that these compressions occur within the elastic-plastic units of the tubular material, preferably mild steel, e.g. ASTM A-53, A-512, A-513, so that, in effect, an enhanced friction zone bubble is produced as the innermost tubular post length continues to penetrate, incrementally, into the upper zone of the outermost tubular post length in response to end loading of the post through roof-floor closure. Accordingly, the nominal outer dimension E of the outermost tubular post length in FIG. 2A expands to dimension F in FIG. 2B which, in the case presently considered, will approximate an increase in 0.020 inches in diameter. Accordingly, there is not only produced the usual wall friction resistance by mere closure of the air gaps G; rather, and in addition, there is an enhancement of such resistance by the radial transverse stress loading of the innermost and outermost tubular post lengths proximate the wedge insertion zone caused by the wedge expanding the innermost tubular post length proximate its area insertion beyond the nominal inside diameter dimension of the outermost tubular post length.

It is noted that all of this is accomplished using off-the-shelf tubular stock for the innermost and outermost tubular post lengths, the innermost one simply being provided with a milled slot, in a preferred form of the invention, to form slot 16.

The wedge can be stamped to the form of a plate and may be of aluminum or other material having an appropriate Young's modulus in accordance with the compression characteristics desired relative to the post and relative dimensional considerations. Thus, the necessity for tack wells, initial compression of the innermost tubular post length prior to tube insertion, and the like, are eliminated.

Utilizing the new system as presented and described herein, the resistance to incremental displacement, where roof-floor closure increments, e.g., are from 10" to 35", is materially enhanced as to the resistance or support in tons. This is illustrated relative to curve 23, which is a characteristic curve as to tests performed with the current system when compared with curve 22 which was representative of tests performed with the prior system as shown in the inventor's prior patent above referenced. Again, this increased performance results from the construction above-described and the operation that horizontal transverse radial loading of the two tubular post lengths proximate wedge position, results in plastic compression of the wall materials within their elastic limits, which substantially augments the normal wall friction forces present through merely reducing the air gaps at G to 0.

Since the wedge is inserted at the mine site, the tubes can be selected from mild steel common stock that are easily telescoped together for transport.

Figure 5:
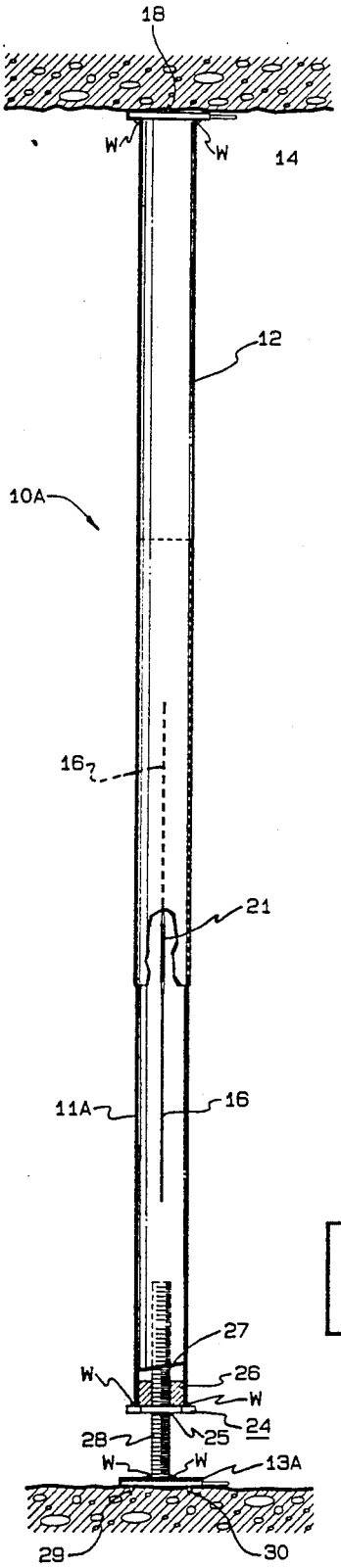
FIG. 5 is a side elevation of an alternate yieldable mine post construction wherein the same is pre-stressed by prior wedge insertion, and where the post also includes a lower, innermost, tubular portion provided with an extensible threaded shaft and also a bearing plate for purposes hereinafter enumerated.

In FIG. 5, an alternate mine support post 10A is seen. The parts are essentially the same excepting for a slight modification as to innermost tubular support member 11A. At the bottom thereof and as an internally threaded end portion, it will be seen that an adapter nut 24 is provided and has, for example, a hex head 25 and, integral therewith, a cylindrical portion 26. Both the hex head 25 and cylindrical portion 26 are internally threaded at 27, this to threadedly receive a shaft 28. The lower end of the shaft is welded at welds W to bearing plate 13A.

The bearing plate 13A includes a pair of protrusions 29 and 30, for example, these preferably placed at the diagonal corners of the rectangular bearing plate 13A. More than two protrusions may be used, of course. However, a single axial protrusion, as at 18, will generally be associated with the bearing plate 14. The reason for this is that when the mine support post is in place and then rotated about its longitudinal axis, the lower bearing plate 13A in FIG. 5 needs to be fixed, whereas the upper bearing plate 14 needs to rotate in accordance with the rotation of the mine support post. Thus, a workman, either manually or by machine, as will hereinafter be pointed out, can simply rotate the post about its longitudinal vertical axis so as to tighten the post, through its selective elongation, thereby maintaining the post in a tight vertical condition between the floor and the mine roof. As the post revolvement takes place, of course, the shaft 28 remains fixed while the adapter nut 24, welded at its head 25, see W, to innermost tubular post length 11A, will rotate with the post and thereby transitionally displaced, along the unit's vertical axis, such that there is a relative elongation of shaft 28 beneath the hex head 25 of adapter nut 24. Of interest is the fact that in most instances, to achieve this, the post construction line is inverted such that the innermost tubular post length is this time lowermost rather than uppermost as seen in FIG. 1. This is for the purpose of insuring that an engagement of the inner end of shaft 28 with wedge 21 will not chance to occur. Accordingly, the shaft 28 will be disposed in the same post length as the wedge.

In FIG. 5 it is seen further that the over-all mine support construction is preloaded; this is to say, the wedge 21 is preliminarily inserted into slot 16 and the tubular construction compressed slightly such that the aforementioned friction and radial transverse loading are produced, with the wedge being positioned within the overlapping portion of tubular post length 12. The result is that the mine support post is adjustable, recoverable, is already preloaded so that the desired resistance to end loading immediately occurs; the post also requiring a minimum of effort to install within the mine.

Figure 6:
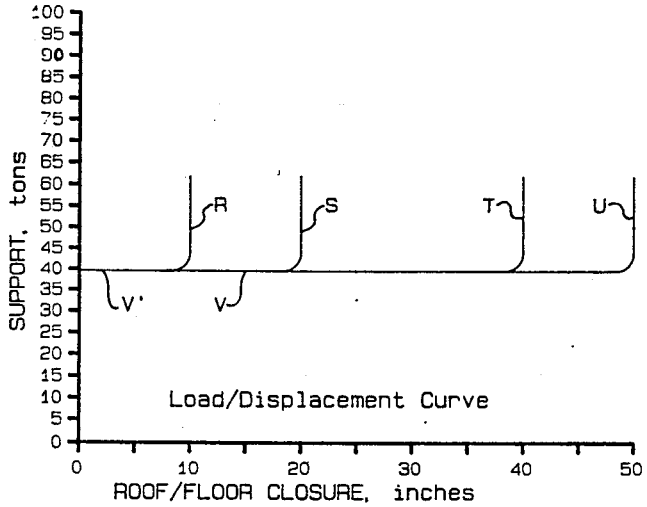
FIG. 6 is a pictorial representation of a series of characteristic curves that may be empirically found through operation of a variety of lengths of mine posts constructed in accordance with the structure seen in FIG. 5.

The characteristic curve pattern of FIG. 6, which relates to the structure of FIG. 5, indicates that for those yield closures, e.g. yield closures 9'', 21'', and 39'' relative to curves R, S, and T which are extensions of primary load curve V, that the beginning point of the common characteristic curve sector V starts at a desired load support point, e.g. 40 tons. The yield closures recited relate to overall support post lengths of 4'-6', 6'-9', and 9'-12', simply given as examples.

In a preferred example of this embodiment of the invention, the threaded shaft 28 comprises No. 18 (2½" Dia.) threaded bar approximately 3 feet long.

Again, as to FIG. 5 special notice to be taken that, rather than requiring tooling for wedge insertion on the inside of the mine, the wedge is pre-inserted at the manufacturing level, e.g., and the post structure slightly compressed to the configuration illustrated in FIG. 5. Thus, in the mine, wedge insertion, tooling, and the process for such insertion are not needed or required by workman. Rather, there is merely required a threading out of shaft 28 for nominal engagement of the two bearing plates 14 and 15A relative to the roof strata and also the floor. Subsequently, the workman will simply rotate, in a direction depending on the threads of shaft 28, the over-all post such that the same is tightly installed, the shaft 28 therefore being incrementally advanced to achieve the tight fit desired. Thus, and owing to the preloading and prior insertion to the wedge, an immediate load support of, e.g., 40 tons is obtained, see characteristic curve portion V'.

Figure 7:
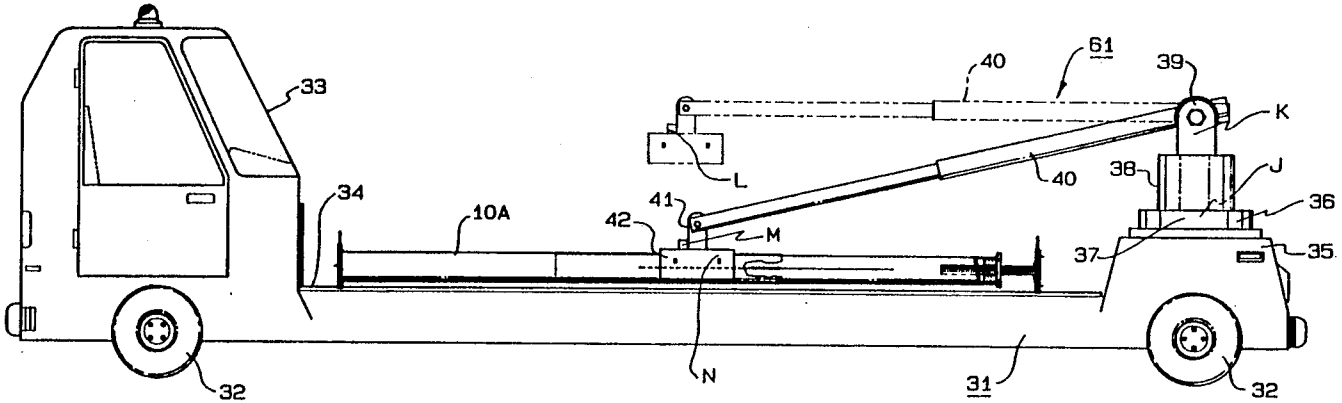
FIG. 7 is a side elevation in reduced scale of a mine vehicle, the same being utilized for transporting the yieldable mine post of the present invention, as well as perhaps other elongate items, and also for erecting and turning such yieldable mine posts as may conform to the design shown in FIG. 5.

FIG. 7 is a pictorial representation of a mine vehicle 31 that can be employed to erect the mine support post of the present invention where such is desired. The use of a machine to install the post will free the workmen from arduous labor as to this aspect of mine roof support. Vehicle 31 includes, as vehicle movement structure, either tractor-type endless tracks or journalled wheels 32, two of which are shown, and a operator cab 33, and also will have an engine, door access, windows, controls and so forth. The vehicle is supplied a bed 34 on which will rest a series of the mine support posts, 10, 10A and so forth for transport and installation. The opposite end of the mine vehicle at 35 may be raised slightly, as indicated, and have a bearing plate 36. Pivotly secured by structure 37 is a crane system support 38 having raised portion 39. Secured to the raised portion 39, which may comprise a clevis, is a boom arm 40 of crane system 61. The boom arm 40 includes a pivot pin 41 for mounting, a clam/shell clamping or jaw mechanism 42. Various lead lines, associated with J, K, L, M and N indicate the placement of the various hydraulic motors J-N of FIG. 9. In lieu of or in addition to a hydraulic system, conventional mechanical and/or electrical systems can be employed for effecting boom and jaw movement, as may be desired.

Figure 9:
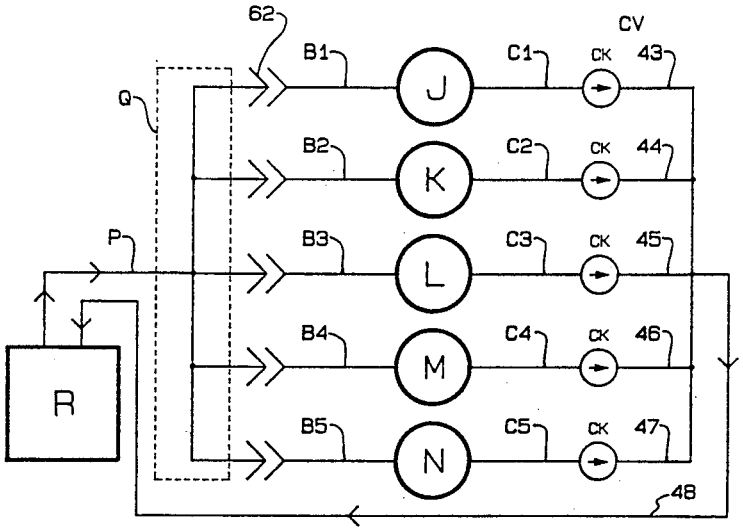
FIG. 9 is a schematic diagram of a simplified hydraulic system that can be employed in connection with the mine vehicle of FIGS. 7 and 8.

In operation, the operator within cab 33 will actuate the hydraulic system of FIG. 9 so as to rotate structure 38 about a vertical access, rotate the boom 40 about a horizontal access, and rotate the clamping mechanism 42 about a horizontal access proximate 41, and then open and close the clam/shell clamping or jaw's mechanism 42 in a manner to grasp and also release the mine support post, as may be desired. FIG. 7 illustrates the structure being used preliminary to lift a horizontally stored mine support post from the bed of the vehicle.

Figure 8:
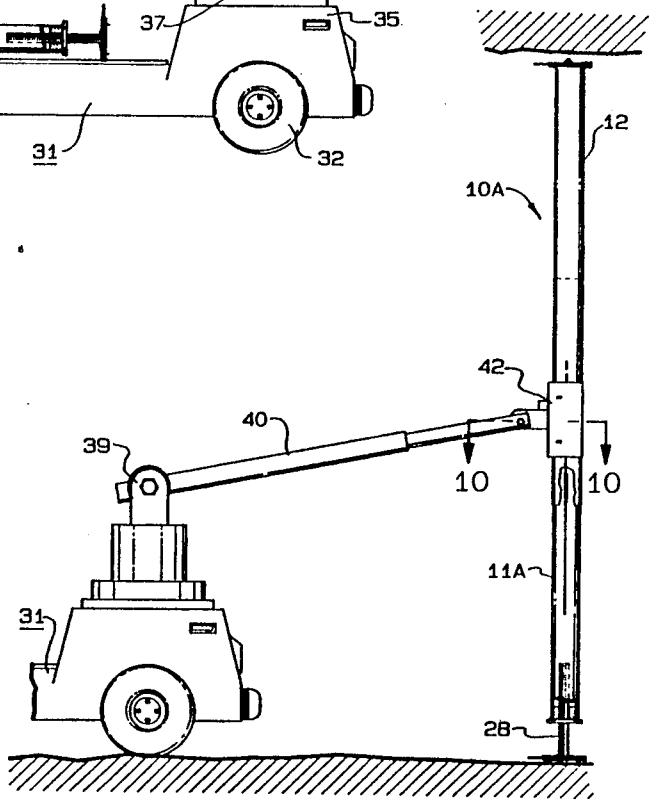
FIG. 8 is a fragmentary view of the front end of the mine vehicle of FIG. 7, this illustrating the hydraulically operated crane or boom structure to vertical placement and powered rotation of the mine posts, one being shown in FIG. 5, about their respective vertical axes.

FIG. 8 illustrates that by simple operation by the operator in cab 33, the mine support posts can be elevated, rotated about, and then held vertically while the equipment provided mechanism 42 will operate actually to rotate the mine support post structure as the same is being held in vertical position.

A simplified hydraulic system is shown in FIG. 9 which can be utilized with the mine vehicle 31 in FIG. 7. The reservoir R with the customary pump includes a pressure line P having a series of quick-connects 62 and branches B1-B5 which lead to hydraulic motors J, K, L, M and N, respectively. The outlet branches C1, C2, C3, C4 and C5 are provided with a series of check valves CV to prevent reverse flow through the motors from others of the branches of the circuit. The output lines at 43, 44, 45, 46, and 47 are coupled to conduit 48 which leads back to the reservoir in the direction of the arrow shown. The operator in cab 33 will have a manual control Q for regulating the coupling of a pressure line P to respective ones or series of ones of the input lines B1-B5 of the respective hydraulic motors.

Figure 10:
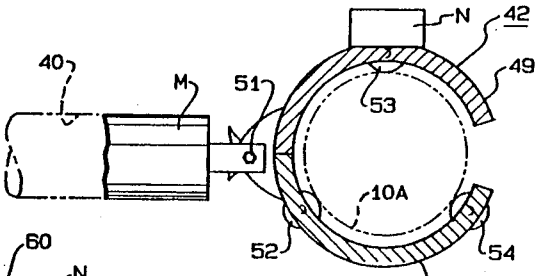
FIG. 10 is a perspective view of the gripping jaws mechanism associated with the beam structure of the mine vehicle of FIGS. 7 and 8; the clamping mechanism is seen to include a friction roller which, when powered, operates to rotate a respective yieldable mine post about its vertical axis for tightening the same in a mine.

FIG. 10 illustrates the clam/shell clamping or jaws' mechanism 42 as including a pair of clamp halves 49 and 50 which are hinged together at 51, suitably attached to the boom 40 by conventional structure, and which includes a series of horizontal journalled rollers 52, 53 and 54. One of these rollers, such as roller 53, may be powered by fluid motor N such that this roller will serve to engage the outer wall of the mine support post and hence rotate the same in place at a time when the vertical position of such mine support post as shown in FIG. 8. Such rotational force is produced by the operator supplying pressure via line P to hydraulic motor N in FIG. 9.

Figure 11:
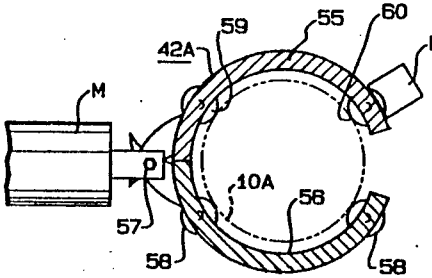
FIG. 11 is similar to FIG. 10 but illustrates an alternate releasable clamping mechanism or jaws' combination wherein simply a friction wheel is used for powering the rotation of the yieldable mine post through frictional coaction thereof with the outer periphery of such post.

In FIG. 11, in slight contrast, the clam/shell jaws or clamping mechanism 42A includes a pair of clamp halves 55 and 56 which are hinged together at 57 and in which include a series of wheels appropriately horizontally journalled at 58 and also 59. An intermediate friction wheel 60 was used and will be driven by fluid motor N, again, so as to rotate the mine support post 10A about its vertical access.

What is provided, therefore, in connection with the structure shown in FIGS. 5-11, is a radially preloaded mine support post, the same having an adjustable mechanism via threaded shaft 28, etc., to provide for a secure placement of the mine support post within a mine. Again, a desired support as to resistance tonnage is immediately supplied, this by virtue of the pre-insertion of the wedge provided before the structure is sent into the mine. Again, rather than relying upon manually turning the post so as to achieve the tight fit desired, a machine can be used not only to transport the mine support post within the mine but also to lift the same from the bed of the mine vehicle, see FIGS. 7 and 8, and manipulate the post in the manner so that it achieves its vertical condition as seen in FIG. 8; subsequently, the operator of the vehicle can operate or control so as to accomplish an automatic rotation of the post so as to tighten the same in place through the rotation of the post about the axis of the threaded shaft 28.

Figure 12:
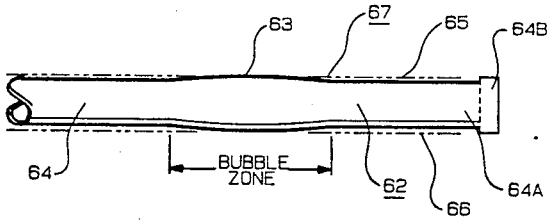
FIG. 12 illustrates the innermost tubular post length generically as including a central bubble zone or bubble portion which is oversize relative to the inside diameter, shown in phantom lines, of the outermost tubular post length; for convenience of illustration, the innermost tubular post length is shown rotated 90 degrees to horizontal disposition, for convenience of illustration, and this likewise applies to the embodiments shown in FIGS. 13–16.

It is well at this point to consider generically the essence of the invention in its preferred form as illustrated generically in FIG. 12. Innermost tubular post length 62 is shown to include a bubble zone or central bubble portion 63 intermediate opposite end lengths 64A and 65. The end length 64A may be provided with an enlarged end extremity 64B, clearing within phantom lines 65 and 66 pertaining to the opposed inside diameter wall lines of the outermost tubular post length 67 corresponding to post length 12 in FIG. 1.

Figure 18:
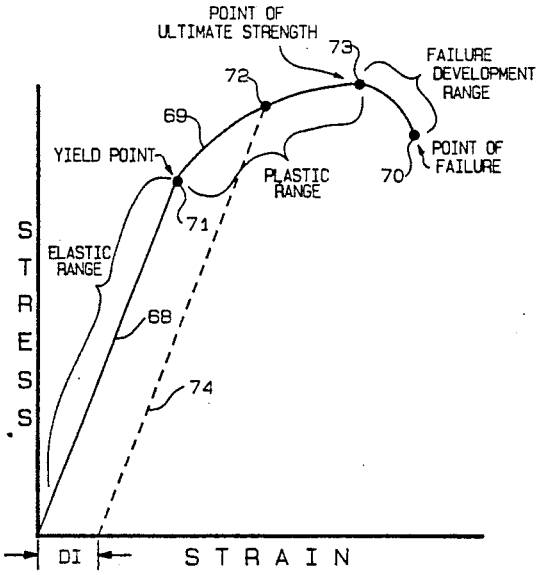
FIG. 18 illustrates stress-strain curves that are preferably utilized in practicing the present invention.

FIG. 12 illustrates generically a basic feature of the present invention. Innermost tubular post length 62 includes a central or medial bubble zone sector or portion 63 which is intermediate post portions 64 and 65. The right end 64A of the post length permissibly includes an enlargement 64B for alignment purposes. Phantom lines 65 and 66 define the hollow interior, generally cylindrical, of the outermost tubular post length 67. Nominally, and excluding consideration of the bubble zone, a radial clear space of, e.g.: 0.005–0.050" will exist between the innermost and outermost tubular post lengths. The "bubble" portion or bubble zone creates a pressure bubble which results in a resistance to axial compressive end loading of the composite post structure. Thus, an interference fit exists, the bubble portion having a girth slightly oversized relative to the inside diameter of the outermost tubular post length. The degree of oversize is such that the coaction between the two telescoping post lengths, resulting in a radial compressive loading between the lengths at the region of the bubble zone, is confined to the combined elastic and plastic ranges of the materials of the post lengths. In this regard, reference is made to FIG. 18 wherein, for conventional structural steel posts, the stress-strain curve 68 for steel materials, to the yield point 71, is essentially a straight line, the preferred region of operation, following Hooke's law of proportionality as to the elastic region. However, it is permissible to extend the range of operation to the plastic region, between the yield point 71 and the point of ultimate strength 73. If the latter is the case, then there will exist a degree of plastic deformation resulting in a degree of set, illustrated by increment DI, but which will not be excessively the case as to disallow the desired and intended elastic contraction, illustrated by dotted line 74, of portions of the outer tubular post member trailing travel of the bubble enlargement of the inner post member. Thus, where radial compressive loading as to the inner tubular post length and the radial tensile stress loading in the outer tubular post length is further increased such that the materials operate within their plastic ranges, see curve section 69, there will be progressively greater strain for a given increase in incremental stress. Operationally proceeding beyond point 73 to the point of failure 70 can cause a burst of the outermost tubular post length, or some other failure. Where the operation is contained below point 73, e.g. at a selected point 72, then a minimum of displacement set DI is experienced, allowing the outermost tubular post length essentially to contract essentially elastically following Hooke's law, see dotted line 74, once the bubble portion passes by, at bubble-trailing regions, thereby tending to preserve the retentive effect of the outer tubular member as it continues circumferentially to offer resistance to further axial movement of the inner tubular member. Thus, radial loading does not suffer diminuation by the tubular member's experiencing unwanted permanent set but rather preserves the essentially elastic interference fit of the members for all incremental relative displacements of the two tubular members. The above conditions of operation preferably will apply to all embodiments of the invention.

Figure 13:
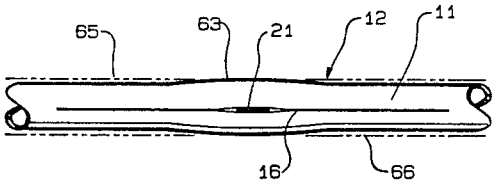
FIG. 13 illustrates, in the manner seen in FIG. 12, the innermost tubular post length having expanded girth at its bubble zone or bubble portion wherein the expanded girth is produced by a slot and wedge construction as seen in FIGS. 1 and 5.

FIG. 13 is similar to FIG. 1 and 5, illustrating the bubble portion or bubble zone at 63 to be provided by the incorporation of a longitudinal wall slot 16 and the incorporation of an expansion wedge 21 as seen in FIGS. 1 and 5. The innermost tubular post length 11, see also FIG. 1, is disposed within outermost tubular post length 12, the same having inner diameter lines or surfaces identified by the phantom lines 65 and 66. The operation of FIG. 13 of course would be the same as that shown and described generically in connection with FIG. 12.

Figure 14:
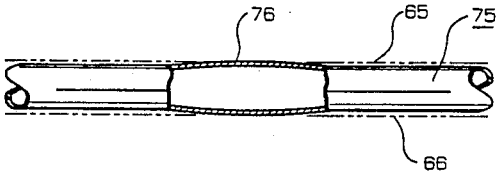
FIG. 14 is similar to FIG. 12 but illustrates an alternate form of the invention wherein the central bubble zone or bubble portion of the innermost tubular post length is simply enlarged by suitable machine-forming outwardly.

FIG. 14 is another embodiment, but illustrates the bubble portion 76 of innermost tubular post length 75 as being formed as by heating such portion of the pipe and using the expansion tool to expand the outer surface of portion 76 into a die, or, alternatively, simply employing a tool which is radially pressurized to produce the expanded girth needed.

Figure 15:
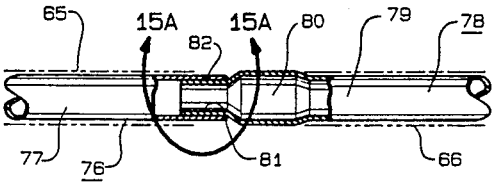
FIG. 15 is another embodiment of the innermost tubular post length wherein the same comprises a pair of composite interjoined sections that are manufactured conveniently to produce the expanded girth of the bubble zone desired.
Figure 15A:
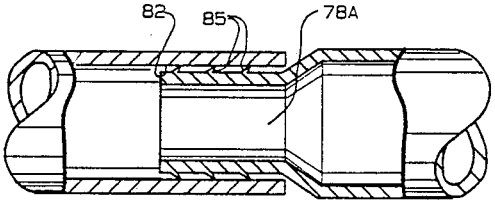
FIG. 15A is a fragmentary detail taken along the line 15A—15A in FIG. 15, illustrating one form of cooperation between the inner and outer members of the post length seen in FIG. 15.
Figure 15B:
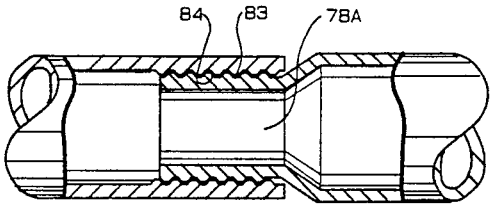
FIG. 15B is similar to FIG. 15A, but illustrates, in lieu of the circumferential tooth construction used in FIG. 15A, there is provided a threaded connection as between the two members.

FIG. 15 is another embodiment of the invention, illustrating that the innermost tubular post length 76 comprised of a portion 77 and member 78. The latter includes portion 79 which is enlarged at 80 to produce the expanded bubble zone or bubble portion, and the latter terminates into an area of reduced diameter dimension at 81. The upper and lower phantom lines 65 and 66 delineate the inside dimension of the outermost tubular post length as may be used, such as at 12 in FIG. 1 or 67 in FIG. 12. Relative to end portions 81 and 82 in FIG. 15, the same will be threaded as seen at 83 and 84 in FIG. 15B, or there can be annularly shaped teeth 85, see FIG. 15A, which are circumferential and which allow for progressive penetration but resist withdrawal of portion 78A of the related tubular member 78 at 78A relative to and portion 82.

Figure 16:
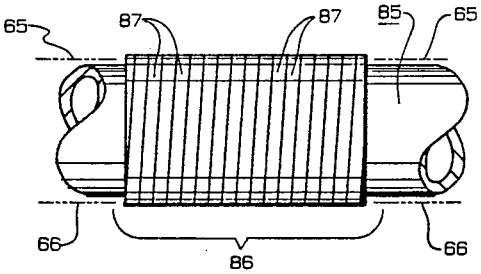
FIG. 16 is similar to FIG. 12 but illustrates that the bubble zone or bubble portion may be formed by a series of helical bead portions, or a composite bead weld that can be provided about the circumference of the post length and then machined so that the outer surfaces of the bead sections are cylindrical and flat in the composite rather than rounded.

FIG. 16 is yet another embodiment of this basic feature of the invention wherein a helical bead weld is disposed about a tubular post length 85 to produce the enlarged central portion, bubble zone or bubble portion, at 86. Phantom line 65 and 66 again delineate the inside diameter lines of the outermost tubular post length such as 67 or 12. Importantly, and as shown, this bubble zone or bubble portion 86, when being composed of the several bead segments 87, is preferably machined cylindrically flat, i.e., eliminating inter-bead-segment valleys by means of the tubular post length 85 simply being inserted into a lathe and the outer curvatures of the individual bead segments machined flat, i.e. flat cylindrically, thereby to achieve the desired interference fit required to produce the pressure bubble desired.

Figure 17:
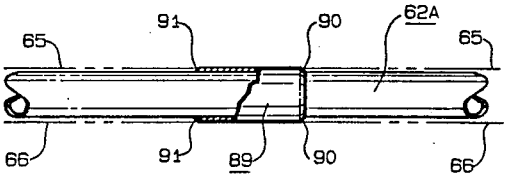

In FIG. 17 inner tubular post member 62A includes a sleeve 89, chamfered preferably at opposite ends 90 and 91, which constitutes the enlarged girth forming the pressure bubble spoken of, and operates essentially as the other embodiments spoken of.

While several structures have been shown and described, illustrating representative constructions to produce the friction bubble spoken of, other types of bubble constructions can perhaps be designed, which will fall within this invention as described and claimed.

In all instances of the various embodiments shown in FIGS. 1, 5, generically in FIG. 12, and FIGS. 13–17, the interference fit desired is at least in the elastic range and certainly within the combination of the elastic and plastic ranges, herein simply referred to as the elastic/-plastic or elastic-plastic range. Any and all other methods and structures as addressed by the appended claims, for producing a friction bubble intermediate the telescoping tubular post lengths are of course comprehended by this invention.

The large end portion 64B, comprising a circumferential ring or simply a formed portion relative to the tube, see FIG. 12, may be either included or not included in the several embodiments indicated as in FIGS. 1, 5 and 12–17. Where so included, the same serves simply for positioning and alignment purposes.

As to the longitudinal dimension of the bubble zones or bubble portions of the respective innermost tubular post lengths, these lengths will vary in accordance of the parameters for a given job as well as the dimensions of the tubes and the end loads anticipated, and so forth. Resistance to loading can be the same, of course, whether the bubble is elongated and the enlarged girth somewhat reduced in outside diameter, or where the bubble zone is constricted but the outer circumference of the bubble zone or portion is enlarged to create a resistance of similar degree.

Although vertical emplacement of the subject mine post has been discussed in detail, the post can of course be installed for support purposes in inclined fashion, or even horizontally, between ribs, walls, or other strata, as mine conditions and support requirements dictate.

Particular embodiments have been shown and described; however, it will be obvious to those skilled in the art that there is modifications and changes will be made without departing from the true spirit of this invention and, therefore, the object in the appended claims is cover all such changes and modifications as are comprehended by the invention.

I claim:

1. A mine support post including, in combination: an innermost tubular post length having a longitudinal wall slot; an outermost tubular post length, having a nominally larger, inner transverse surface boundary than the nominal outer transverse periphery of said innermost tubular member, slideably and telescopingly receiving said innermost tubular post length; and wedge means inserted into said wall slot at a point initially proximate but beyond said outermost tubular post length and dimensioned to spread apart said wall slot and thereby incrementally increase the girth of said innermost tubular post length, at and proximate the area of wedge means' insertion, and likewise thereby expand the internal size of the tubular opening of said outermost tubular post length at least when said post is compressed through end-loading, whereby to selectively increase wall-friction forces between said innermost and outermost tubular post lengths and also produce elastic/plastic mutually intercooperating radially compressive deformation and elastic stress-loading thereat in said innermost and outermost tubular post lengths, for further progressively increasing resistance to compression end loading of said post.

2. The mine support post of claim 1 wherein said wall slot is interior of and thereby spaced from the opposite ends of said innermost tubular post length.

3. The mine support post of claim 1 wherein the materials and sizing of said wedge means and tubular post lengths and wall slot are mutually selected in accordance with the load/displacement operational curve desired.

4. The mine support post of claim 1 wherein said wedge means comprises a wedge plate of resilient, wedge thickness compression character.

5. The mine support post of claim 1 wherein the interaction of said wedge means and inner and outer tubular post lengths form a friction bubble having a maximum diameter size greater than the nominal outermost diameter size of said outermost tubular post length.

6. The mine support post of claim 1 wherein the transverse cross-sections of said post lengths are cylindrical.

7. A mine support post including, in combination, a pair of telescoping, tubular lengths each having opposite ends, said tubular lengths having mutually overlapping end portions, the innermost one of said lengths having a longitudinal wall slot spaced from its said opposite ends, and wedge means for spreading apart said wall slot and thereby expanding the girth of said innermost length such that, when said support post undergoes end compression loading which tends to compress said post and said wedge means assumes an increasing position of penetration within the outermost one of said lengths, such expanded girth as is produced likewise simultaneously provides an elastic expansion of said outermost tubular length which radially inwardly compresses against said inner tubular length to thereby augment the wall friction forces thereat in increasingly tending to restrict mutual longitudinal displacement of said lengths in response to increases in end-loading of said post.

8. An adjustable, axially revolvable, yieldable mine post having a central axis of revolvement and including, in combination, first and second, mutually telescoping, tubular post lengths each having an outermost end, said tubular post lengths comprising innermost and outermost tubular post lengths, said outermost end of said first tubular post length having a first transverse bearing member, said outermost end of said second tubular post length having a fixed, internally threaded end portion and being provided with an adjustable, threaded, extensible portion cooperatively threaded into said threaded end portion and provided with a second transverse bearing member, said tubular post lengths being conjointly provided with means, nominally peripherally oversized relative to the transverse interior dimension of said outermost post length, whereby to provide controlled resistance to relative movement between said post lengths upon compression loading of said mine post.

9. The structure of claim 8 wherein said second bearing member has plural, mutually spaced, outwardly extending protrusions displaced from said central axis, said first bearing member having a single, essentially axial, outwardly projecting protrusion aligned with said central axis.

10. An adjustable, axially revolvable, yieldable mine post having a central axis and including, in combination, first and second, mutually telescoping and mutually frictionally engaged, tubular post lengths mutually disposed in frictional surface contact, each of said post lengths having an outermost end, said outermost end of said first tubular post length having a first transverse bearing member provided an axial protuberance extension, said outermost end of said second tubular post length having a fixed, internally threaded end portion and being provided with an adjustable, threaded, extensible portion cooperatively threaded into said threaded end portion and provided with a second transverse bearing member, said second transverse bearing member having off-axis protrusions, and means for radially loading said frictional surface contact of said tubular post lengths whereby to increase end-loading frictional resistance of said mine post.

11. The structure of claim 10 wherein said extensible portion comprises a threaded shaft, said outermost end of said second tubular post length having threaded means as said internally threaded end portion for threadedly receiving said shaft.

12. The structure of claim 11 wherein said threaded means comprises a nut, fixedly secured to said outermost end of said second tubular post length, and having a reduced portion fitting within the same said outermost end.

13. An adjustable, prestressed, yieldable mine support post designed for erection and strata-support placement and including, in combination, upper and lower, mutually telescoping and mutually frictionally engaged, tubular post lengths each having an outermost end, said lower post length being disposed within said upper post length, means for expanding the girth of said lower post length at a region within said upper post length and for radially compressively loading and thereby prestressing said post lengths within their elastic/plastic material ranges, said outermost end of said lower tubular post length including a threaded extensible portion provided with a bearing plate, said outermost end of said lower tubular post length including internally threaded fixed means threadedly receiving said threaded extensible portion.

14. Structure of claim 13 wherein said lower tubular post length includes a slot disposed within said upper tubular post length, and wedge means positioned within said slot for expanding the girth of said lower tubular post length at a region with said upper tubular post length.

15. A mine post for incrementally resisting axial end loading and including, in combination, inner and outer, mutually telescoping, tubular, cylindrical, post members, said outer post member having a transverse, nominally cylindrical interior, said inner post member having opposite end portions and a friction bubble intermediate portion intermediate with respect to and contiguous with said opposite end portions, said intermediate portion having a continuous, peripheral, raised, incrementally larger transverse girth than said transverse cylindrical interior of said outer tubular member, whereby to cooperate with said outer tubular member in an interference fit, the dimensions of said intermediate portion being selected such that the radial compression of said intermediate portion and the radial expansion of said outer tubular member as to said interference fit, in the coaction of said inner and outer tubular post members, is within the elastic-plastic combined ranges of the materials of said tubular post members.

16. The structure of claim 15 wherein said end portions of said inner tubular post length have peripheral clearance relative to the interior of said outer tubular post member.

17. The structure of claim 15 wherein one of said end portions is provided with a peripherally raised alignment extremity.

18. The structure of claim 15 wherein said intermediate portion of said inner post member is formed by an essentially transverse peripheral bead weld determined at its outer surface to provided a desired cylindrical interference surface periphery for said interference fit.

19. The structure of claim 15 wherein said intermediate portion of said inner post member is formed by an essentially transverse peripheral helical bead weld machined at its outer surface to provided a desired cylindrical interference surface periphery for said interference fit.

20. The structure of claim 15 wherein said intermediate portion is formed at the manufacturing stage to provide said enlarged girth.

21. The structure of claim 15 wherein said intermediate portion of said inner tubular post is provided with a longitudinal wall slot, and wedge means inserted in said wall slot whereby to provide said expanded girth for said interference fit.

22. The structure of claim 15 wherein an extremity of said intermediate portion and one of said end portions meet at a physical juncture.

23. The structure of claim 15 wherein said intermediate portion is dimensioned, in consideration of the materials and dimensions of said inner and outer tubular post members, such that said outer tubular post member elastically contracts toward its nominal condition at areas past which said intermediate portion travels.

24. The structure of claim 15 wherein said intermediate portion includes a chamfered sleeve secured to said inner post member.

25. The structure of claim 22 wherein said physical juncture comprises a threaded juncture.

26. The structure of claim 22 wherein physical juncture comprises a pressed fit juncture.

27. A metal mine post construction including, in combination, inner and outer, mutually telescoping tubular, cylindrical post members, said inner post member having a continuous, peripheral raised intermediate portion provided with an expanded girth whereby to cooperate with said outer member in a radially loaded interference fit, said intermediate portion passing longitudinally incrementally along and within said outer post member in response to axially compressive end loading of said mine post, said intermediate portion being dimensioned such that said outer post member contracts at regions trailing said intermediate portion, whereby to preserve a degree of transverse radial loading, produced by said interference fit, as said intermediate portion incrementally travels within and along said outer post member in response to progressive axial end loading of said post member when installed.

28. A metal mine post construction including, in combination, inner and outer, mutually telescoping tubular, cylindrical post members, said inner post member having a transversely continuous, peripherally raised, friction-bubble portion provided with an expanded girth cooperating with said outer member in a radially loaded interference fit, said intermediate portion being dimensioned to pass longitudinally incrementally along and within said outer post member, essentially precluding the production of permanent set in the latter, in response to axially compressive end loading of said mine post, whereby to resist and continue to resist said end loading in a desired manner.

* * * * *